United States Patent [19]

Solak et al.

[11] Patent Number: 4,970,874

[45] Date of Patent: Nov. 20, 1990

[54] ADJUSTABLE HEIGHT GRILLE COVER ASSEMBLY FOR A REFRIGERATION APPARATUS

[75] Inventors: Gregory P. Solak, Newburgh; George W. Sisk, Evansville, both of Ind.

[73] Assignee: Whirlpool Corporation, Benton Harbor, Mich.

[21] Appl. No.: 369,649

[22] Filed: Jun. 20, 1989

[51] Int. Cl.[5] ..... F25D 23/13

[52] U.S. Cl. ..... 62/258; 62/259.1; 62/440; 312/116; 312/236; 312/237

[58] Field of Search ..... 62/259.1, 263, 258, 62/440; 49/55; 52/507, 509, 632, 645; 312/236, 237, 116

[56] References Cited

U.S. PATENT DOCUMENTS

| | | | |
|---|---|---|---|
| 2,176,334 | 10/1939 | Gibson . | |
| 2,603,548 | 7/1952 | Harbison | 312/237 |
| 2,934,913 | 5/1960 | Haines et al. | 62/258 X |
| 2,961,851 | 11/1960 | Ehrenfreund | 62/258 X |
| 3,912,349 | 10/1975 | Hoetker | 312/236 |
| 4,038,800 | 8/1977 | Daley, Jr. | 52/507 |

*Primary Examiner*—Lloyd L. King

*Attorney, Agent, or Firm*—Wood,Phillips,Mason,Recktenwald & VanSanten

[57] ABSTRACT

An adjustable height grille cover assembly is provided for a refrigeration apparatus including a cabinet having top mounted machine components. The cover is provided for concealing the machine components. The cover includes an adjustable height mounting panel which is mountable to the cabinet forwardly of the machine components. A frame assembly includes top and bottom frame pieces and opposite side frame pieces. The side frame pieces are selected from a plurality of select side frame pieces in accordance with the selected height of the mounting panel. Suitable fasteners are included for mounting the frame assembly to the mounting panel.

20 Claims, 6 Drawing Sheets

ADJUSTABLE HEIGHT GRILLE COVER ASSEMBLY FOR A REFRIGERATION APPARATUS

BACKGROUND OF THE INVENTION

1. Field of the Invention

This invention relates generally to refrigerator cabinets and, more particularly, to an adjustable height grille cover therefor.

2. Description of Background Art

A refrigeration apparatus, such as a refrigerator/freezer, includes a cabinet having a storage compartment and a door for the compartment. Connected refrigeration machine components, such as a compressor and a condenser are provided for producing refrigerator air for cooling the storage compartment. In conventional free-standing cabinets, such connected components are typically mounted on a rear wall of the cabinet or below the cabinet.

More recently, built-in refrigeration apparatus cabinets, which are provided to blend in with kitchen cabinets, have found greater acceptance in domestic applications. Such built-in units are installed in a predefined location in a kitchen. For example, such a built-in refrigerator cabinet is usually flush mounted with adjacent kitchen cabinets and may include decorative panels which match the doors on the kitchen cabinets.

In a typical installation for a built-in refrigerator, an opening is provided approximately the size of the cabinet. Advantageously the refrigerator cabinet suitably fills in the space provided so that it effectively blends in.

Once the a built-in refrigeration apparatus cabinet is installed it is preferable to leave the cabinet in place. Therefore, access must be provide for the machine components in the event that servicing is necessary. Known commercially available built-in refrigeration units include a condenser and compressor mounted at the top of the cabinet in a machine compartment. By mounting the machine components on the top of the unit, the service technician can gain ready access in the event that problems occur.

In order to conceal the top-mounted machine components, a cover must be provided for concealing the same. Further, since air circulation must generally be provided for cooling the machine components, the cover must also serve as a grille or vent to permit air passage from the kitchen to the machine compartment. Ideally, such a cover is of a decorative nature to be unobtrusive within the kitchen environment.

Known built-in refrigeration units have non-adjustable, louvered or decorative panels grilles that are used to cover the top machine compartment. Such a cover is sufficient as long as the size of the space provided corresponds to the height for the refrigerator cabinet. However, it is not unusual to find variations in kitchen construction resulting in the available space being larger or smaller than desired.

The present invention is intended to overcome one or more of the problems as set forth above, in a novel and simple manner.

SUMMARY OF THE INVENTION

In accordance with one aspect of the invention, a built-in refrigeration apparatus is provided with means for selectively adjusting the height of a machine compartment cover between a maximum height and a minimum height.

Broadly, there is disclosed herein an adjustable height top cover for a built-in refrigeration apparatus intended to be installed in a predefined location, wherein any such location may have a different vertical size opening. Such a refrigeration apparatus includes a cabinet having top mounted machine components. The top cover is adapted for concealing the machine components and comprises a mounting panel, means for fixedly mounting the mounting panel to the cabinet forwardly of the machine components, a frame assembly including means for adjusting the height of the frame assembly to satisfy the vertical size opening, and means for mounting the frame assembly to the mounting panel.

More specifically, an adjustable height cover assembly according to the invention includes an adjustable height mounting panel. Means are provided for fixedly mounting the mounting panel tot he cabinet forwardly of the machine components. A frame assembly includes top and bottom frame pieces and opposite side frame pieces, the side frame pieces being selected from a plurality of select side frame piece sizes in accordance with the selected height of the mounting panel. Means are provided for mounting the frame assembly to the mounting panel.

It is a feature of the invention that where the machine components include means for circulating machine cooling air, the grille cover assembly includes means for permitting cooling air to pass therethrough in communication with the circulating means.

In one embodiment of the invention, the grille cover assembly further comprises an adjustable height decorative panel comprising a back plate, selectable height side trim pieces, means fastening the side trim pieces to the back plate, top and bottom trim pieces, and means for adjustably mounting the top and bottom trim pieces tot he back plate according to a selected height of the side trim pieces.

It is a feature of the invention that the frame assembly includes means for fastening the side frame pieces to the top and bottom frame pieces.

It is another feature of the invention that the mounting panel comprises a two-piece mounting panel.

It is yet a further feature of the invention that the two pieces of the mounting panel are assembled in overlapping relationship and the vertical height of the mounting panel is determined by the amount of overlap.

According to a further aspect of the invention disclosed herein, a method is provided of assembling an adjustable grille for a built-in refrigeration apparatus including a cabinet having top mounted machine components, the grille being adapted for mounting tot he cabinet for concealing the machine components. The method comprises the steps of adjusting the height of an adjustable height mounting panel in accordance with a desired grille height, fastening top and bottom frame pieces to the adjustable height mounting panel, selecting side frame pieces having a height corresponding to the desired grille height, fastening the side frame pieces in fixed association with the mounting panel to provide a grille assembly, and securing the grille assembly to the cabinet.

In an alternative embodiment, such a method further comprises the steps of providing a decorative panel mounting plate, fastening top and bottom trim pieces to the mounting plate, the vertical spacing between the top and bottom trim pieces corresponding to the desired grille heights, selecting side trim pieces, the side trim pieces having a height corresponding to the desired grille height, fastening the side trim pieces in fixed association with the mounting plate, and securing the mounting plate to the mounting panel.

Further features and advantages of the invention will readily be apparent from the specification and from the drawings.

DETAILED DESCRIPTION OF THE INVENTION

Figure 1:
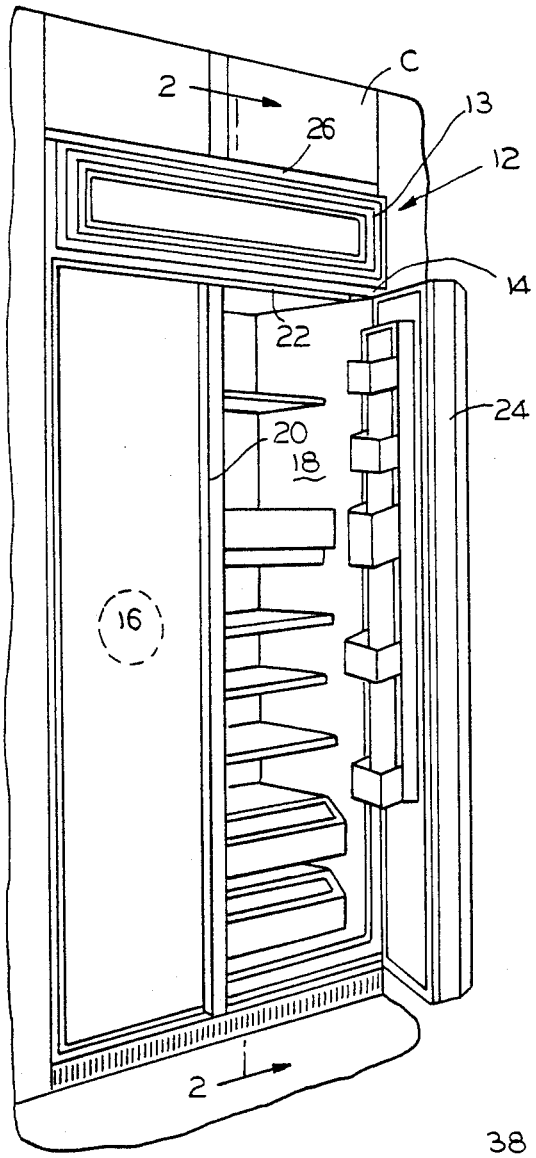
FIG. 1 is a perspective view of a built-in refrigerator/freezer having an adjustable height grille cover embodying the invention.

Referring to FIG. 1, a refrigeration apparatus, such as a refrigerator/freezer 10, includes an adjustable height grille cover assembly 12 having an adjustable height decorative panel 13 according to the invention. The invention is shown utilized with a built-in, side-by-side refrigerator/freezer; however, other types of refrigeration apparatus may be used in conjunction with the adjustable grille cover assembly of the present invention, as will be obvious to those skilled in the art.

The refrigerator/freezer 10 includes a cabinet 14 housing a below-freezing, or freezer, compartment 16 and a fresh food, or above-freezing, compartment 18. The freezer compartment is accessible through an access opening (not shown). A freezer door 20 is provided for selectively closing the freezer access opening. Similarly, the fresh food compartment 18 includes an access opening 22 and a fresh food door 24 is provided for selectively closing the fresh food access opening 22.

As specifically illustrated in FIG. 1, the refrigerator/-freezer 10 is adapted to be mounted flush and immediately adjacent to kitchen cabinets C. The cabinets C are installed to provide a rectangular opening 26 for receiving the cabinet 14. Particularly, the vertical size of the opening 26 is adapted to be of a size slightly larger than the standard size of the cabinet 14.

Figure 2:
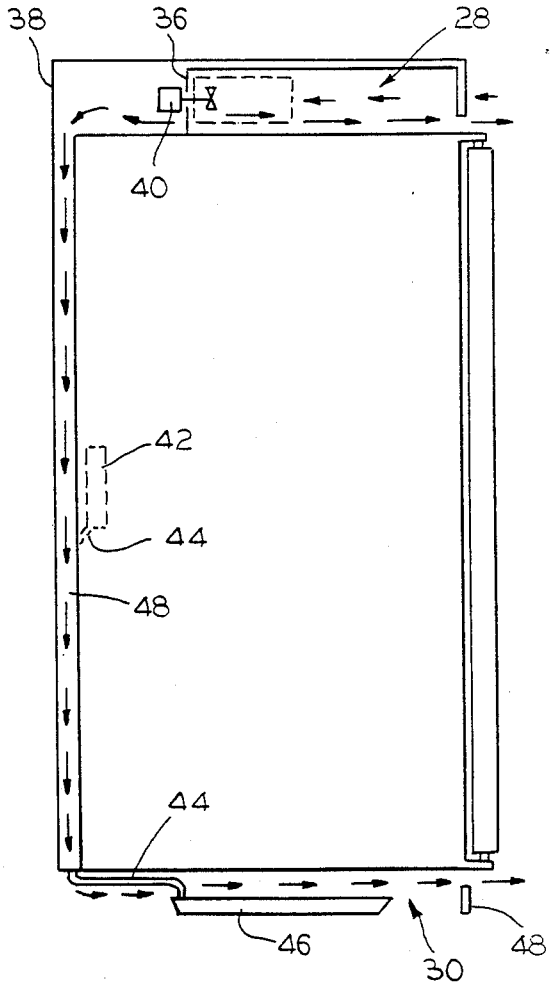
FIG. 2 is a side view of the refrigerator freezer of FIG. 1, with parts removed for clarity, schematically illustrating the flow of machinery compartment cooling air.
Figure 3:
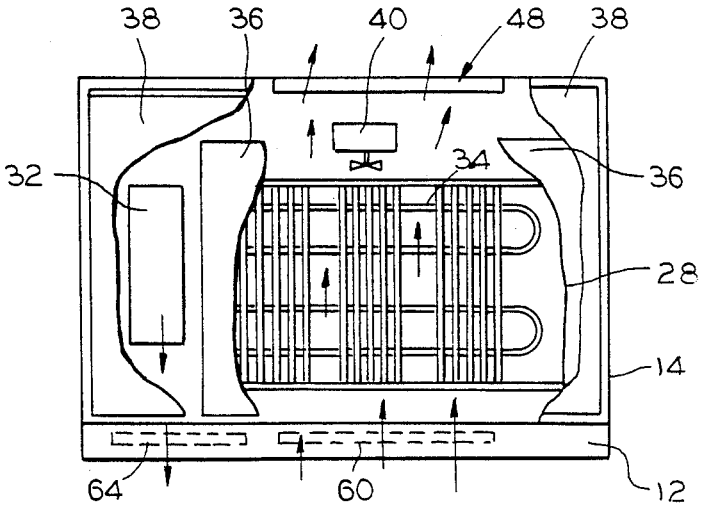
FIG. 3 is a generalized top view of the refrigerator/-freezer of FIG. 1, schematically illustrating the flow of machinery compartment cooling air.

Referring also to FIGS. 2 and 3, a top machine compartment 28 is provided at the top of the cabinet 14, while a lower machine compartment 30 is provided below the cabinet 14. Conventional refrigeration machine components, such as a compressor 32 and a condenser 34, are top mounted in the upper machine compartment 28. The condenser 34 is housed in an inner housing 36 which separates it from the compressor 32. The inner housing 36 encloses the sides and the top of the condenser 34. An outer housing 38 is provided for housing the entire upper machine compartment 28. The outer housing 38 encloses all sides of the upper machine compartment, except for the front.

A cooling fan 40 is provided for drawing machine compartment cooling air past the condenser 34 and to the compressor 32. Particularly, the cooling fan 40 is installed to draw room air through the decorative grill assembly 12 into the inner housing 36 and over the condenser 34 to cool the same. A portion of the cooling air is then directed by the fan 40 into the outer housing 38 where it passes over the compressor 32 to cool the sam and exhausts through the decorative grille assembly 12.

Thus, as is apparent from the above the grille cover assembly 12 serves to close the front of the inner and outer housings 36 and 38, respectively, in order to conceal the machine compartment components; to fill in the space between the top of the cabinet 14 and adjacent kitchen storage cabinets C; and to provide for ventilation for the top mounted refrigeration components.

A conventional evaporator 42 is mounted within the cabinet 14. During a defrost cycle, defrost water from the evaporator 42 flows through a tube 44 down to a large-area shallow evaporator pan 46 mounted in the lower machine compartment 30. The air drawn by the cooling fan 40 is heated due to the heat generated by the condenser 34. A portion of the heated air travels down through a duct 48 on the rear of the cabinet 14 and down into the lower machine compartment 30 where it passes over the evaporator pan 46 and out through a front grille base cover 48. The heated air is used to evaporate any water collected in the pan 46.

For aesthetic reasons, it is desirable that virtually the entire opening 26 provided in the cabinets C be filled in. The vertical height of the refrigerator/freezer 10 may be adjusted using conventional levelling legs (not shown), as is well known. However, where it is desirable to provide a toe space corresponding to that for adjacent cabinets the amount of adjustment of the cabinet 14 is limited As might be expected, due to variations in kitchen construction, the full height of the opening 26 may vary from one installation to another. In accordance therewith, the grille assembly 12 is provided with means for adjusting the vertical height of the same so that an installer may easily, quickly and inexpensively compensate for such variations in kitchen construction.

Figures 4, 5:
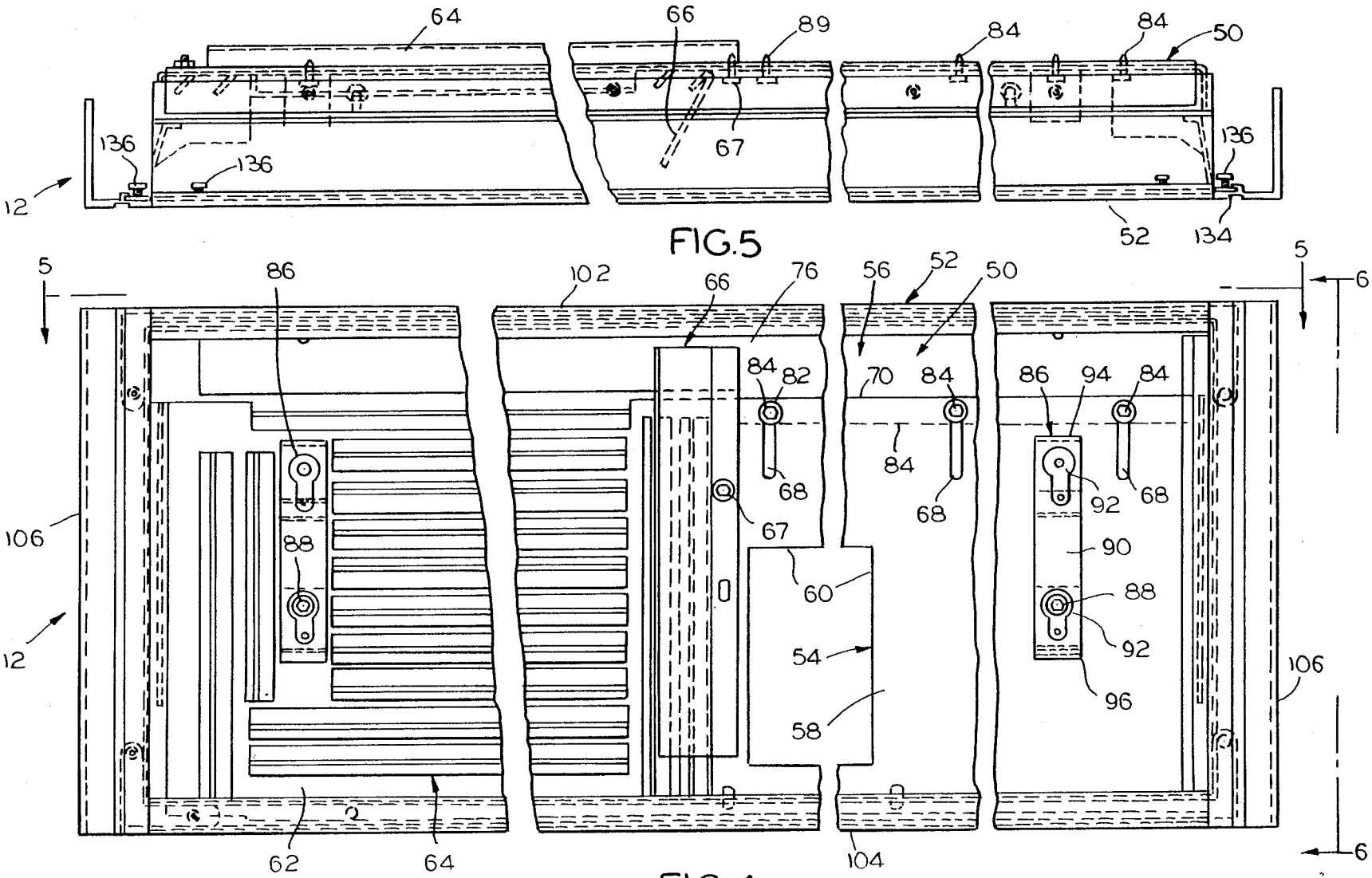
FIG. 4 is a front elevational view of the adjustable height grille cover assembly according to the invention.
FIG. 5 is a plan view of the grille cover assembly taken along the line 5—5 of FIG. 4.
Figure 6:
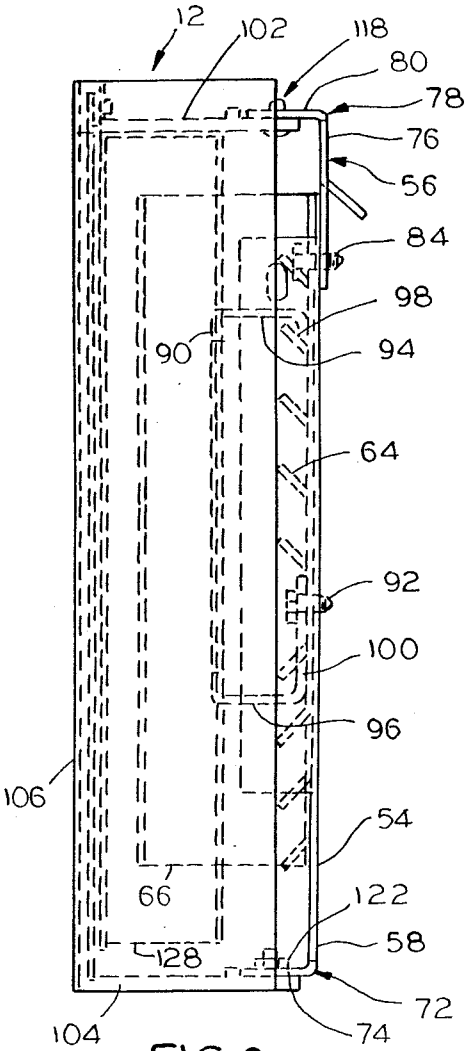
FIG. 6 is a side view of the grille cover assembly taken along the line 6—6 of FIG. 4.

Referring to FIGS. 4–6, the decorative grille assembly 12 is illustrated with the decorative panel 13 removed for clarity.

The decorative grille assembly 12 includes a mounting panel assembly 50 and a frame assembly 52. The frame assembly 52 is illustrated particularly in FIGS. 7–9, discussed below.

The mounting panel assembly 50 is of two-piece overlapping construction and includes a mounting panel bottom piece 54 and a mounting panel top piece 56. The mounting panel bottom piece 54 comprises an elongated, rectangular flat plate 58 including a generally centrally located, rectangular opening 60 The plate 58 is stamped and formed at one end 62 to provide louver openings 64. Specifically, and referring to FIG. 3, the position of the opening 60 is determined so that it lies forwardly of the condenser 34 in alignment with the inner housing 36. The louvered opening 64 is forwardly of the compressor 32 and is disposed outwardly of the inner housing 36. Thus, the opening 60 serves as an intake for cooling air, while the louvered opening 64 serves as an exhaust for heated air passed by the condenser 34 and compressor 32, as discussed above.

A deflector plate 66 is fastened using a screw 67 to the mounting panel bottom piece 54 between the opening 60 and the louvered opening 64. The deflector plate prevents exhaust air from mixing with intake air.

A plurality of laterally extending longitudinally spaced slots 68 are provided adjacent a top edge 70 of the mounting panel bottom plate 58. The bottom of the mounting panel bottom plate 58 is turned forwardly at a corner edge 72 to provide a bottom flange 74.

The mounting panel top 56 comprises an elongated generally rectangular flat plate 76 turned at a corner edge 78 to a forwardly extending top flange 80. A plurality of fastener openings 82 are provided adjacent a bottom edge 84 of the mounting panel top plate 76. The openings 82 are spaced similarly to the mounting panel bottom piece slots 68.

A plurality of fasteners, such as screws 84, are used for fastening the mounting panel top 56 to the mounting panel bottom 54. Particularly, each screw 84 passes through one of the slotted openings 68 into an aligned mounting panel top screw opening 82. The amount of overlap between the mounting panel bottom 54 and the mounting panel top 56 can be adjusted by varying the position of the screws 84 in the slots 68 to selectively adjust the vertical spacing between the bottom flange 74 and the top flange 80, see FIG. 6.

A pair of decorative panel mounting brackets 86 are fastened to the mounting panel bottom plate 58 using suitable fasteners 88. Specifically, each mounting bracket 86 includes a front wall 90 having a pair of spaced keyhole slots 92 therethrough, connecting to rearwardly turned top and bottom walls 94 and 96, respectively, connected to inwardly turned rear wall sections 98 and 100, respectively. The fasteners 92 pass through openings (not shown) in the rear wall sections 98 and 100 to secure the brackets 86 to the mounting panel bottom plate 58.

Figure 7:
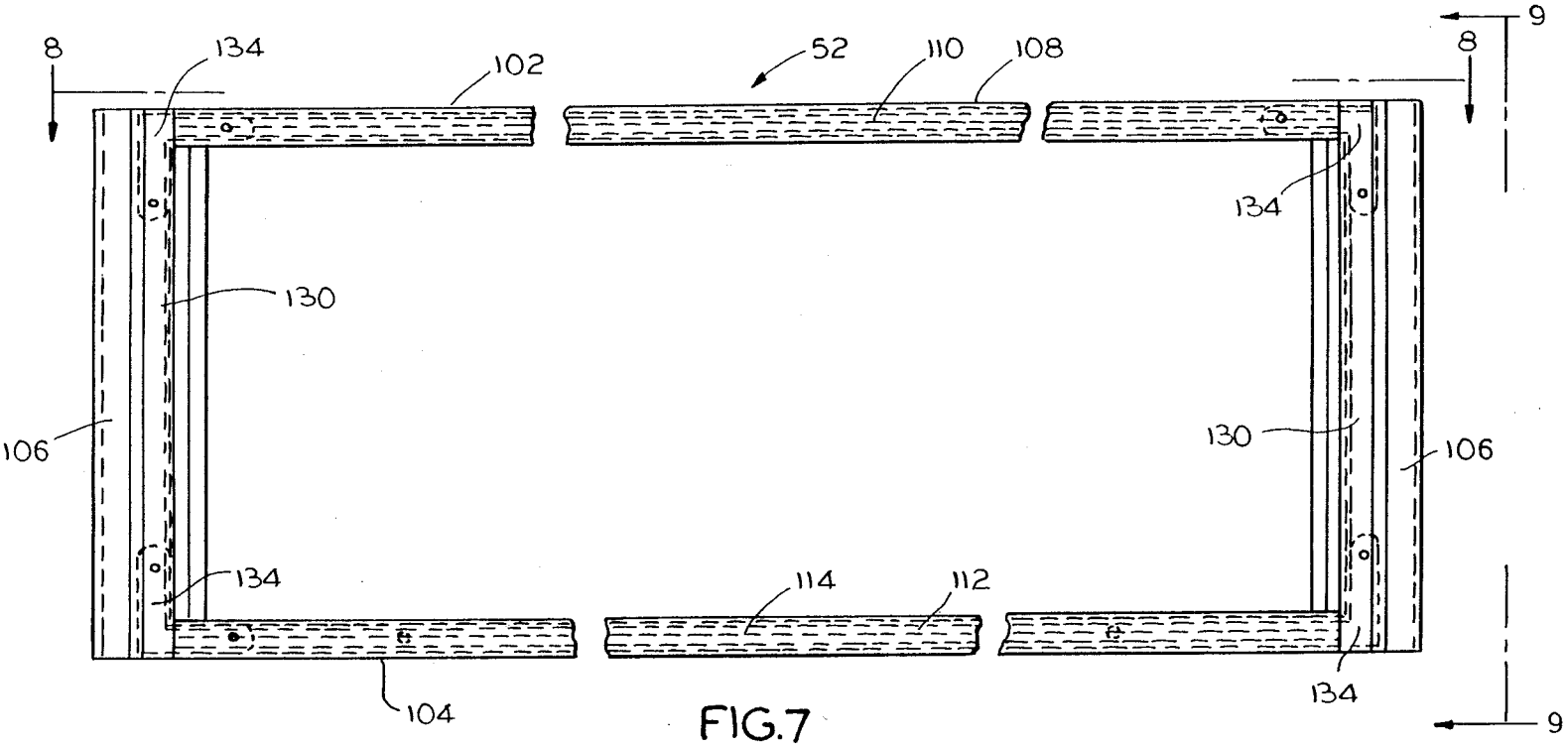
FIG. 7 is an elevational view of a frame assembly of the adjustable height grille cover assembly of FIG. 4.
Figure 8:
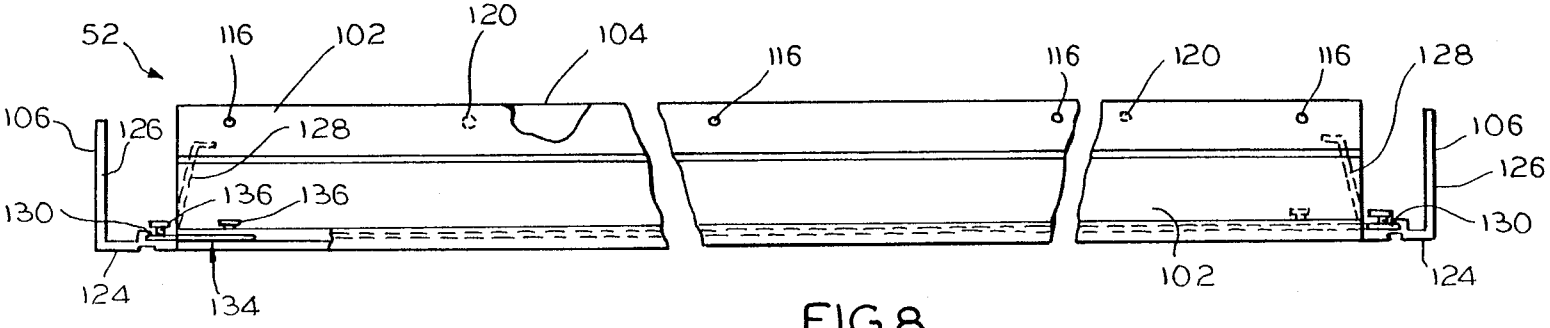
FIG. 8 is a plan view of the frame assembly taken along the line 8—8 of FIG. 7.
Figure 9:
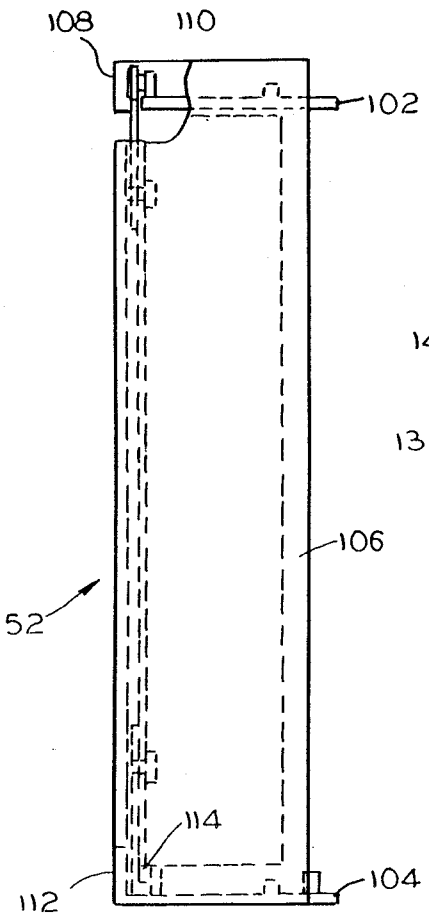
FIG. 9 is a side view of the frame assembly taken along the line 9—9 of FIG. 7.

Referring now to FIGS. 7–9, the frame assembly 52 is illustrated. The frame assembly 52 comprises a top frame piece 102, a bottom frame piece 104, and opposite side frame pieces 106. In the illustrated embodiment, each of the frame pieces 102, 104 and 106 is of extruded metal construction. The length of the top and bottom frame pieces 102 and 104 is precut according to the width of the cabinet 14. To provide for adjustable height applications, a plurality of different length side frame pieces 106 may be provided, which such pieces are selectively utilized according to the desired grille height. Alternatively, the side trim pieces could be machined at the installation site according to the desired grille height. In an exemplary embodiment, the refrigerator/freezer 10 is provided with three sets of side frame pieces 106 to provide one of three different heights, namely seven and one-half inches; eight inches; and eight and one-half inches. These specific heights are referred to way of example only, and are not intended to be limiting, but rather any desired height could be provided.

Referring specifically to FIG. 9, the top frame piece 102 is generally L-shaped and includes a forward facing, upwardly turned decorative front wall 108. A rearwardly opening channel 110 is provided behind the front wall 108. The bottom frame piece 104 is also generally L-shaped and includes an upwardly turned decorative front wall 112. A rearwardly opening channel 114 is provided behind the front wall 112.

A plurality of apertures 116, see FIG. 8, are provided through the top frame piece 102 for securing the same to the mounting panel top flange 80 using suitable fasteners 118, see FIG. 6. It should be noted that bottom frame piece 104 is held to bottom flange 74 via a nut and screw as shown in FIG. 6, and frame piece 104 is provided with holes for screws to hold the decorative grille assembly 12 to a trim piece located on the refrigerator as detailed below. Similarly, a plurality of apertures 120, see FIG. 8, are provided through the bottom frame piece 104 for securing the same to the mounting panel bottom flange 74 using suitable fasteners 122, see also FIG. 6. Thus, the vertical spacing between the top frame piece 102 and the bottom frame piece 104 is determined in accordance with the selected overlap between the mounting panel top and bottom pieces 5 and 56, respectively, as discussed above. The length of the side frame pieces 106 is determined according to the selected vertical spacing.

Referring specifically to FIG. 8, each of the side frame pieces 106 is generally U-shaped and includes a front wall 124 connected to outer and inner rearwardly extending side walls 126 and 128, respectively. A rearwardly opening channel 130 is formed behind the front wall 124.

A plurality of L-shaped corner keys 134 are provided, one for each corner, for connecting the side frame pieces 106 to the top frame piece 102 and the bottom frame piece 104. Particularly, each corner key 134 is insertable within the channels 110, 114 and 130 discussed above, and suitable fasteners 136 are used to retain the corner key 134 in its associated channel.

Figure 12:
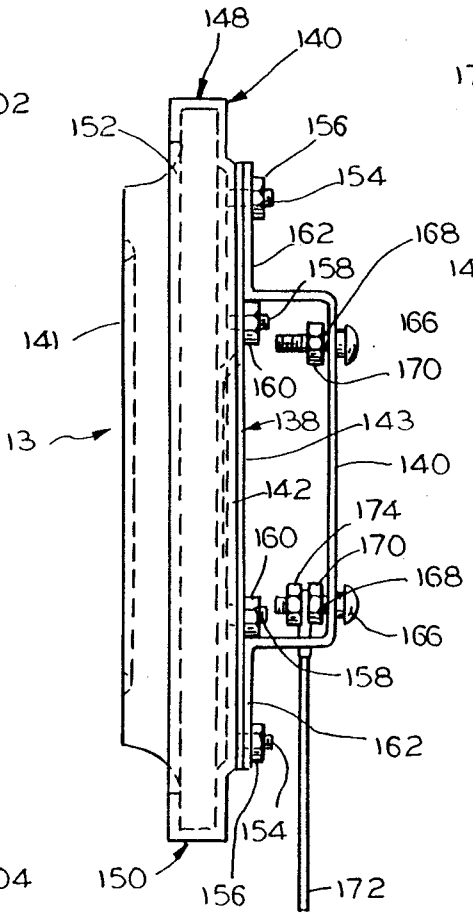
FIG. 12 is a side view of the adjustable height decorative panel taken along the line 12—12 of FIG. 10.
Figure 10:
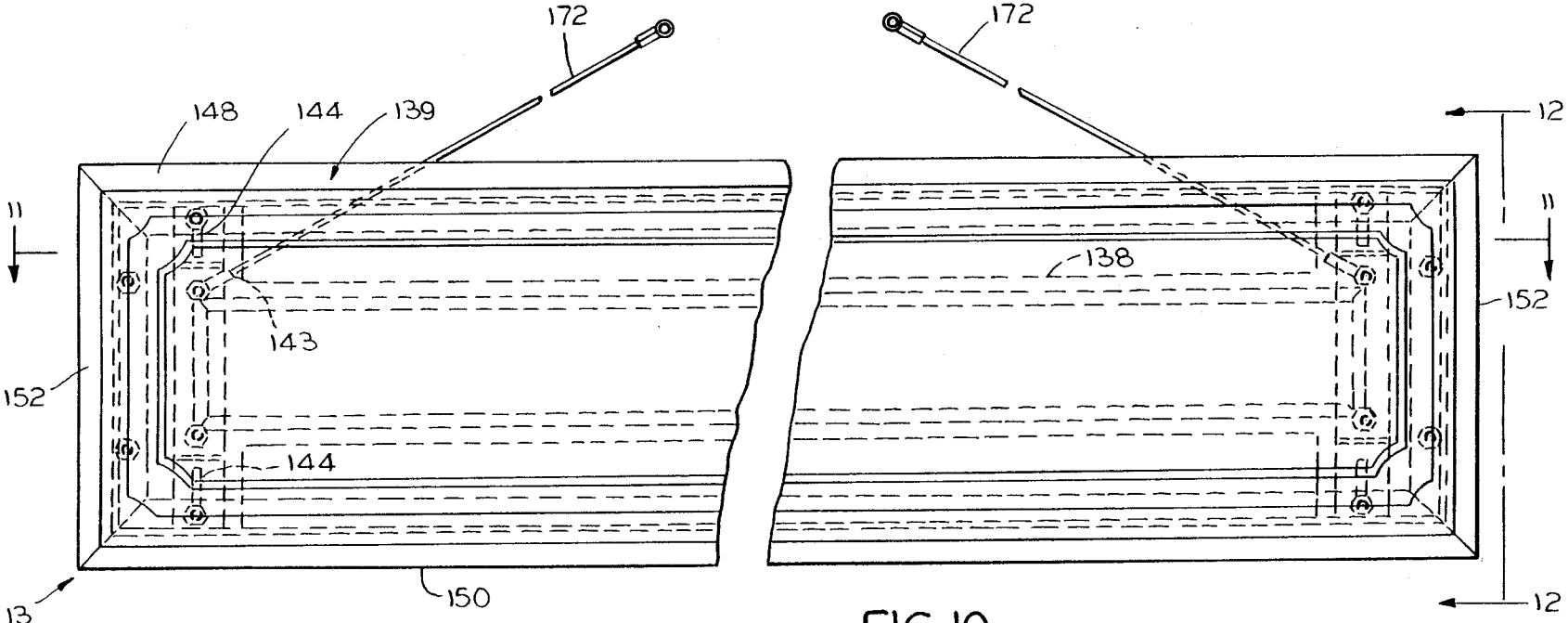
FIG. 10 is front elevational view of an adjustable height decorative panel mountable to the adjustable height grille cover assembly of FIg. 4.
Figure 11:
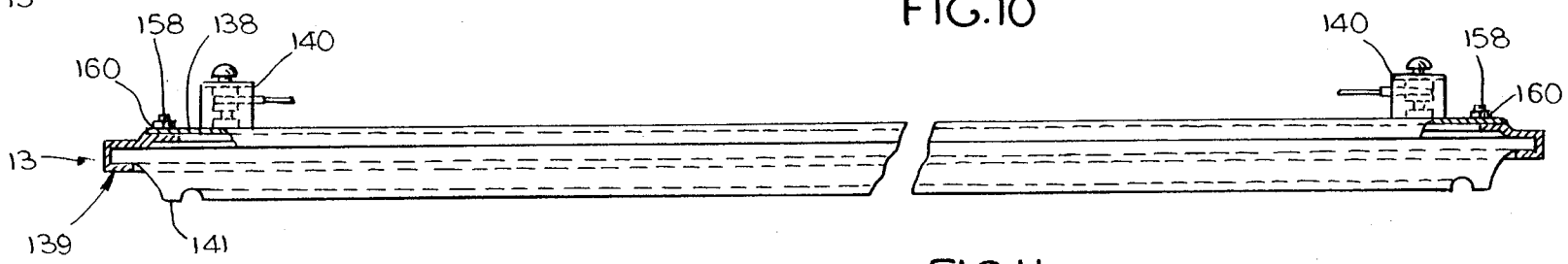
FIG. 11 is a plan view of the adjustable height decorative panel taken along the line 11—11 of FIG. 4.

With reference to FIGS. 10–12, the decorative panel 13 is shown in greater detail. As discussed above, the mounting bracket 86 for the decorative panel is fixedly mounted to the grille frame assembly mounting plate bottom 54. As a result, if the height of the grille assembly 12 is adjusted, as by adjusting the overlap between the mounting panel top 56 and the mounting panel bottom 54, the vertical spacing between the top frame piece 102 and the bottom frame piece 104 varies. However, the spacing of the decorative panel 13 remains fixed relative to the bottom frame piece 104. It is desirable that the height of decorative panel 13 also be adjustable so that it is symmetrical relative to the grille assembly 12. Thus, the decorative panel 13 comprises an adjustable height decorative panel.

The decorative panel 13 includes a backup plate 138, an insert support assembly, or frame 139, and a pair of mounting brackets 140. Also, a decorative insert, such as a wood panel 141 is held in place via the frame 139. Advantageously, the insert 141 matches the adjacent cabinets C, see FIG. 1.

Figure 15:
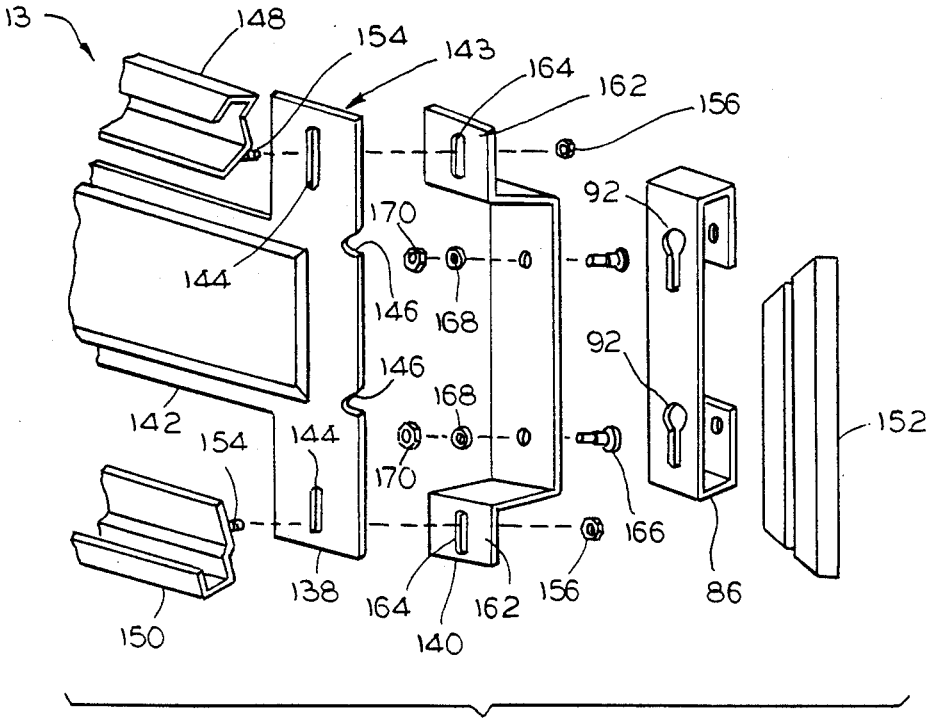
FIG. 15 is a perspective exploded view generally illustrating the assembly of the decorative panel and the mounting of the same to the decorative grille assembly.

The backup plate 138 in the illustrative embodiment comprises an elongated sheet metal plate 142 including enlarged end portions 143, see FIG. 15. A pair of laterally extending and laterally spaced slots 144 are provided in each end portion 143. Also, a pair of laterally spaced notches 146 are provided at each end portion 143 between the slots 144.

The decorative panel frame 139 includes a top trim piece 148, a bottom trim piece 150, and opposite side trim pieces 152. Each trim piece 148, 150 and 152 is generally J-shaped in cross section and is mitered at each end. A rearwardly extending threaded element 154 is welded or otherwise secured to the rear of the top and bottom trim pieces 148 and 150, adjacent the mitered ends. The spacing between the threaded elements 154 corresponds to the longitudinal spacing between the slots 144 of the backup plate 138. The top and bottom trim pieces 148 and 150 are secured to the backup plate 138 by inserting the threaded elements 154 through the slots 144 and screwing on a nut 156. The vertical height of the decorative panel 13 is adjusted by varying the position of each threaded element 154 in its associated slot 144.

Each of the side trim pieces 152 also includes a pair of rearwardly extending threaded elements 158. To install each side trim piece 152, the side trim piece is aligned with the threaded elements 158 resting in the backup plate notches 146, and nuts 160 are threaded thereon to secure the same.

As discussed above, the vertical spacing between the top and bottom trim pieces 148 and 150 can be adjusted according to the desired height of the grille assembly 12. Resultantly, the length of the side trim pieces 152 must also be adjusted. Advantageously, the decorative panel assembly 13 is provided with a plurality of preselected length side trim pieces 152. The particular side trim piece used is determined according to the desired height. Alternatively, a single length side trim piece 152 could be used, which such side trim piece could be machined on-site according to the desired height.

Each of the mounting brackets 140 is generally U-shaped and includes a pair of opposite outwardly extending flanges 162. Each flange 162 includes an elongated slot 164. Specifically, the slots 164 are spaced apart a distance corresponding to the backup plate slots 144. In fact, the bracket 140 is secured to the backup plate 138 by aligning the respective associated slots 162 and 144 so that the top and bottom trim piece threaded elements 154 pass through both slots 144 and 164 and ar secured with the nuts 156.

Fastened to each mounting bracket 144 are a pair of rearwardly extending double shoulder screws 166. The screws 166 are secured utilizing a wave washer 168 and a nut 170. The wave washer 168 acts like a spring and provides a slight amount of tension when mounting the decorative panel assembly 13, as discussed below.

A safety cord 172 is secured to each mounting bracket 140 utilizing a second nut 174 threaded on on of the double shoulder screws 166.

Figure 13:
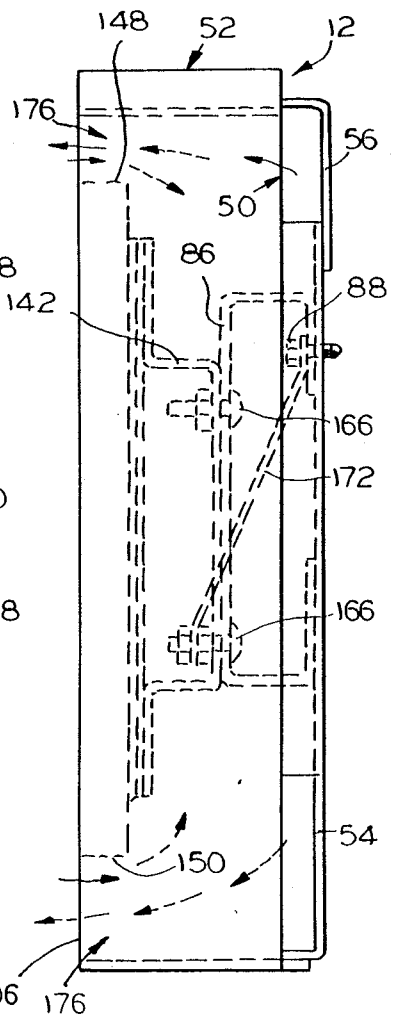
FIG. 13 is a side view particularly illustrating the decorative panel of FIG. 10 mounted to the grille assembly of FIG. 4.

With reference also to FIG. 13, the grille assembly 12 is illustrated with the decorative panel assembly 13 installed. Particularly, the decorative panel assembly 13 is positioned inside of the frame assembly 5 forwardly of the mounting panel assembly 50. The double shoulder screws 166 are inserted in the mounting bracket key slots 92 to retain the same. Also, one end of each safety cord 172 is secured to the mounting panel bottom piece 54 utilizing one of the mounting bracket fasteners 88. Thus, when the decorative panel assembly 13 is to be removed, the safety cord 172 prevents the decorative panel assembly 1 from falling which could cause injury to a user or installer thereof.

The outer dimensions of the decorative grille assembly 13 are less than the inner dimensions formed by the grille frame assembly 52. Thus, a peripheral space 176 is provided between the panel assembly 13 and the frame assembly 52. This peripheral space 176 permits room air to be drawn in through the mounting panel opening 60, see FIG. 4, and also permits exhaust air from the louvered opening 64 to pass outwardly into the room. The size of the space at the top and the bottom is controllably adjusted by varying the vertical height of the grille assembly 12 and decorative panel assembly 13, as discussed above. Preferably, the space at the top is equivalent to the space at the bottom.

Figure 14:
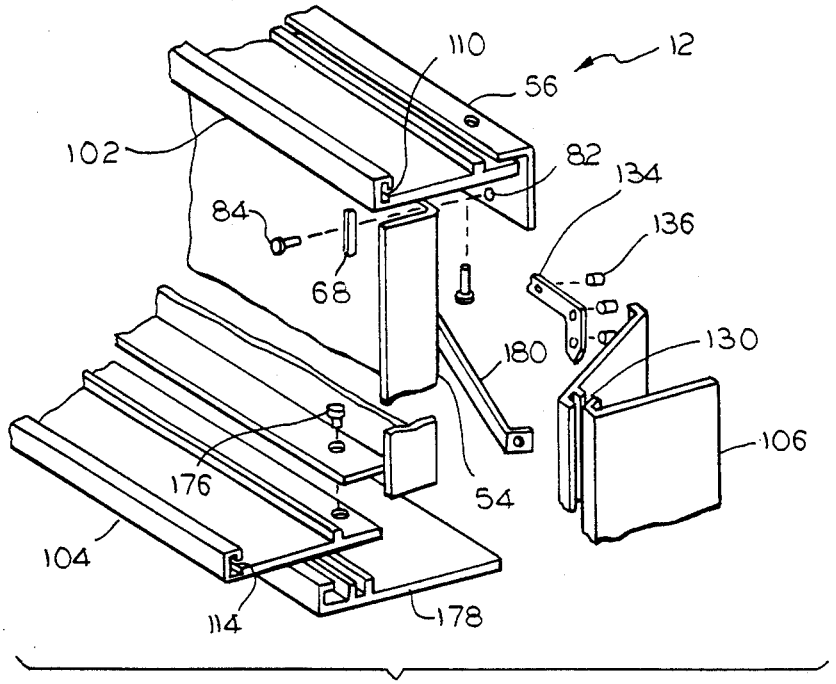
FIG. 14 is a perspective exploded view generally illustrating the assembly of the decorative grille assembly.

With reference to FIG. 14, an exploded view illustrates a method for assembling the decorative grille assembly 12. The mounting panel bottom 54 is fastened to the mounting panel top 56 by inserting the screws 84 through the mounting panel bottom slotted openings 68 and into the mounting panel top openings 82. The vertical height of the adjustable grill assembly 12 is determined in accordance with the position of the screw 84 within the slot 68, and thus the overlapping of the two pieces 54 and 56. The frame assembly top piece 102 is fastened to the mounting panel top piece 56 utilizing the fasteners 118. The frame assembly bottom piece 104 is fastened to the mounting panel bottom 54 utilizing fasteners 122, see FIG. 6. The side frame pieces 106 are fastened to the top and bottom frame pieces 102 and 104, respectively, by inserting the corner keys 134 into the appropriate channels 110 or 114 and 130 and securing them in place using the fasteners 136. The adjustable grille assembly 12 is fastened to the cabinet 14 utilizing fasteners 176 through the mounting panel bottom 54, the bottom frame piece 104, and into a cabinet trim piece 178 which is fastened to the top of the cabinet 14, see FIG. 1, in any known manner. Also, a brace 180 may be fastened to the mounting panel bottom piece 54 and to the top of the cabinet 14 to further secure the decorative grille assembly in place.

With reference to FIG. 15, an exploded view illustrates a method for assembling the decorative panel assembly 13.

The top trim pieces 148 and 150 are fastened to the backup plate 138 and to the bracket 140 by inserting the threaded elements 154 through the slots 146, 164 and securing them with the nuts 156, the bracket 140 including the double shoulder screws 166 suitably secured thereon. The decorative insert 141 is held in place between the top and bottom trim pieces 148 and 150, and the side trim pieces 152 are secured placing one at each end with the threaded elements 158 inserted in the backup plate notches 146 and utilizing the nuts 156, see FIG. 12. The double shoulder screws 166 are then inserted in the grille assembly mounting bracket keyhole slots 92 to retain the decorative panel assembly 13 to the grille assembly 12. As is particularly illustrated in FIG. 15, the grille assembly mounting bracket 86 is of a greater thickness at the lower portion of the keyhole slots 92 than at the top portion. Resultantly, when the double shoulder screws 166 are moved downwardly, the spring action provided by the wave washers 168 in connection with the relatively thicker portion of the bracket 86 acts to wedge the decorative panel assembly 13 in place so that it is held firmly in position.

In the field, when the refrigeration apparatus 10 is installed, the user can adjust the height of the grille assembly 12 by adjusting the overlap between the grille assembly top mounting panel 56 and bottom mounting panel 54 and replacing or machining the side frame pieces 106. Also, the decorative panel assembly 13 can be adjusted by adjusting the vertical spacing between the top and bottom trim pieces 148 and 150 and replacing or machining the side trim pieces 152. As is apparent, the decorative insert 141 may also be trimmed as necessary to satisfy the selected vertical height.

Thus, the invention broadly comprehends a grille cover for a built-in refrigerator which includes means for selectively adjusting the height of the grille between a maximum height and a minimum height.

We claim:

1. In a built-in refrigeration apparatus including a cabinet having a top wall, a machine compartment housing machine components mounted on said top wall, and a grille mounted to said top wall forwardly of said machine compartment for concealing said machine components, the improvement comprising:

means for selectively adjusting the height of said grille, by varying a vertical dimension thereof, between a maximum height and a minimum height.

2. In a built-in refrigeration apparatus for installation in a predefined location, wherein any such location may have a different vertical size opening, said refrigeration apparatus including a cabinet having top mounted machine components, an adjustable height top cover for concealing said machine components comprising a mounting panel;

means for fixedly mounting said mounting panel to said cabinet forwardly of said machine components;

a frame assembly including means for adjusting the height of said frame assembly to satisfy the vertical size opening; and means for mounting said frame assembly to said mounting panel.

3. The top cover of claim 2 wherein said machine components comprises means for circulating machine cooling air and said top cover further includes means for permitting cooling air to pass therethrough in communication with said circulating means

4. The top cover of claim 2 further comprising a decorative panel and means for mounting said decorative panel to said mounting panel

5. The top cover of claim 2 further comprising an adjustable height decorative panel and means for mounting said decorative panel to said mounting panel.

6. The top cover of claim 5 wherein said adjustable height decorative panel comprises a backup plate, selectable height side trim pieces, means fastening said side trim pieces to said backup plate, top and bottom trim pieces, and means for adjustably mounting said top and bottom trim pieces to said backup plate according to a selected height of said side trim pieces.

7. The top cover assembly of claim 5 wherein said mounting means comprises means for removably mounting said decorative panel to said mounting panel

8. The top cover of claim 5 wherein said machine components comprises means for circulating machine cooling air and said mounting means mounts said decorative panel in spaced relation with said mounting panel to permit cooling air to pass thereby in communication with said circulating means.

9. The top cover of claim 2 wherein said frame assembly includes top and bottom frame pieces and side frame pieces, said side frame pieces having a height selected to satisfy the vertical size opening

10. The method of assembling an adjustable grille for a built-in refrigeration apparatus including a cabinet having top mounted machine components, said grille being adapted for mounting to said cabinet for concealing said machine components, comprising the steps of:

adjusting the height of an adjustable height mounting panel in accordance with a desired grille height;

fastening top and bottom frame pieces to said adjustable height mounting panel;

selecting side frame pieces, said side frame pieces having a height corresponding to the desired grille height;

fastening said side frame pieces in fixed association with said mounting panel to provide a grille assembly; and securing said grille assembly to said cabinet.

11. The method of claim 10 wherein said selecting step includes the step of providing a plurality of preselected height frame pieces.

12. The method of claim 10 further comprising the step of mounting a decorative panel to said mounting panel.

13. The method of claim 10 further comprising the step of removably mounting a decorative panel to said mounting panel.

14. The method of claim 10 further comprising the steps of providing a decorative panel mounting plate, fastening top and bottom trim pieces to said mounting plate, the vertical spacing between said top and bottom trim pieces corresponding to the desired grille height, selecting side trim pieces, said side trim pieces having a height corresponding to the desired grille height, fastening said side trim pieces in fixed association with said mounting plate, and securing said mounting plate to said mounting panel.

15. An adjustable height grille cover assembly mountable to a refrigeration apparatus including a cabinet having top mounted machine components, said cover being provided for concealing said machine components, comprising:

an adjustable height mounting panel;

means for fixedly mounting said mounting panel to said cabinet forwardly of said machine components;

a frame assembly including top and bottom frame pieces and opposite side frame pieces, said side frame pieces being selected from a plurality of select side frame pieces in accordance with a selected height of said mounting panel; and means for mounting said frame assembly to said mounting panel.

16. The grille cover assembly of claim 15 wherein said machine component includes means for circulating machine cooling air and said grille cover assembly further includes means for permitting cooling air to pass therethrough in communication with said circulating means.

17. The grille cover assembly of claim 15 further comprising an adjustable height decorative panel comprising a back plate, selectable height side trim pieces, means fastening said side trim pieces to said back plate, top and bottom trim pieces, and means for adjustably mounting said top and bottom trim pieces to said backup plate according to a selected height of said side trim pieces.

18. The grille cover assembly of claim 15 wherein said frame assembly further comprises means for fastening said side frame pieces to said top and bottom frame pieces.

19. The grille cover assembly of claim 15 wherein said mounting panel comprise a two piece mounting panel.

20. The grille cover assembly of claim 19 wherein said two pieces are assembled in overlapping relationship and the vertical height of said mounting panel is determined by the amount of overlap.

* * * * *